US006874424B2

(12) United States Patent
Bailey et al.

(10) Patent No.: US 6,874,424 B2
(45) Date of Patent: Apr. 5, 2005

(54) LOW VOLTAGE PYROTECHNIC IGNITER ASSEMBLY

(76) Inventors: Samuel Walters Bailey, 5705 Lassies Way, Wesley Chapel, FL (US) 33544; James Patrick Hassett, 8724 McAdam Pl., Tampa, FL (US) 33634

( * ) Notice: Subject to any disclaimer, the term of this patent is extended or adjusted under 35 U.S.C. 154(b) by 0 days.

(21) Appl. No.: 10/408,984

(22) Filed: Apr. 8, 2003

(65) Prior Publication Data

US 2004/0020393 A1 Feb. 5, 2004

Related U.S. Application Data

(60) Provisional application No. 60/370,866, filed on Apr. 9, 2002.

(51) Int. Cl.[7] ..... C06C 5/06

(52) U.S. Cl. ..... 102/275.11; 102/202.12; 102/202.5; 102/202.9; 102/202.14

(58) Field of Search ..... 102/202.5, 202.9, 102/202.12, 202.14

(56) References Cited

U.S. PATENT DOCUMENTS

| | | | | | |
|---|---|---|---|---|---|
| 1,912,423 | A | * | 6/1933 | Ayer | 102/202.12 |
| 2,003,483 | A | | 6/1935 | Frye | |
| 2,114,176 | A | | 4/1938 | Christ | |
| 2,315,823 | A | * | 4/1943 | Smith | 102/202.3 |
| 3,125,025 | A | * | 3/1964 | Boggs et al. | 102/202.9 |
| 3,503,333 | A | * | 3/1970 | Estes | 102/202.11 |
| 3,941,056 | A | * | 3/1976 | Janoski | 102/202.5 |
| 5,070,789 | A | * | 12/1991 | True et al. | 102/275.12 |
| 5,123,355 | A | * | 6/1992 | Hans et al. | 102/202 |
| 6,082,264 | A | * | 7/2000 | Meyer et al. | 102/202.9 |
| 6,189,403 | B1 | * | 2/2001 | Berninger | 414/918 |
| 6,247,763 | B1 | * | 6/2001 | Rehn et al. | |
| 6,553,911 | B1 | * | 4/2003 | Walker et al. | 102/202.7 |

* cited by examiner

*Primary Examiner*—Michael J. Carone
*Assistant Examiner*—Lulit Semunegus

(57) ABSTRACT

The electric pyrotechnic igniter of the present invention comprises a controlled power source providing low-voltage electricity to one or more remotely located, replaceable ignition elements which are housed in compression clips capable of holding the ignition elements into direct contact with firework fuses.

5 Claims, 2 Drawing Sheets

Clip, Assembled View With Element in Place

Clip, Exploded View

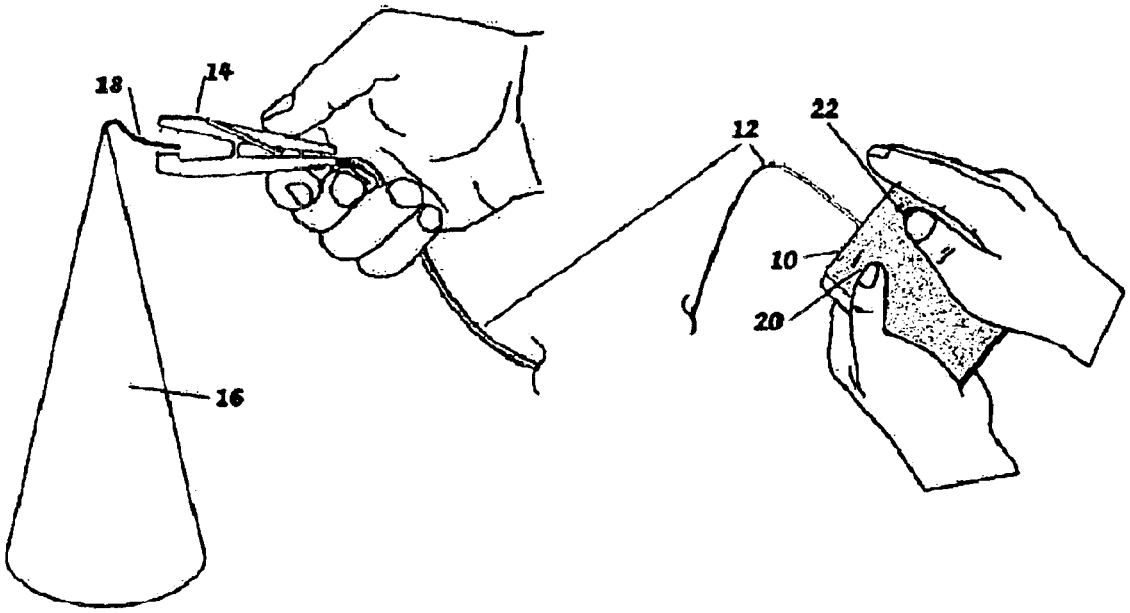
Fig. 1 - Low Voltage Pyrotechnic Igniter Assembly in Use

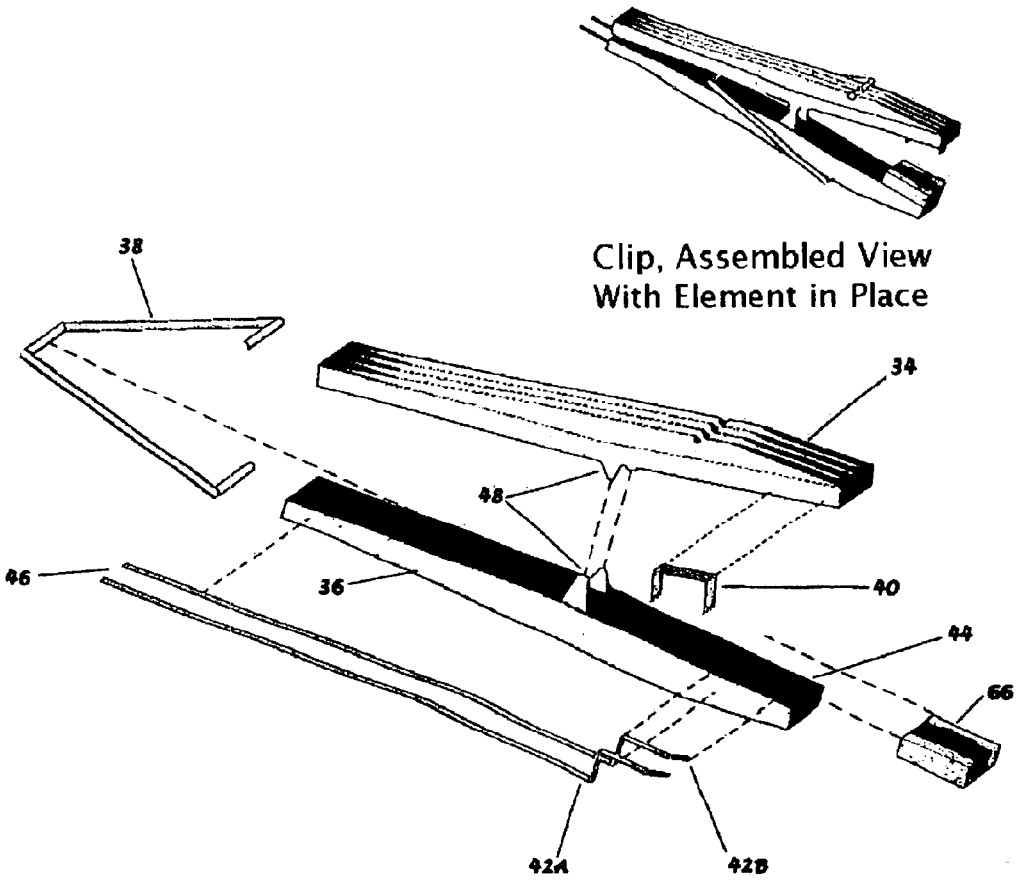
Fig. 2 - Clip, Exploded View
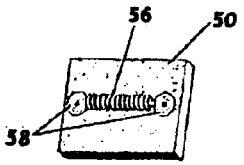
Fig. 3 - Heating Element

LOW VOLTAGE PYROTECHNIC IGNITER ASSEMBLY

This application claims the benefit of provisional application No. 60/370,866, filed Apr. 9, 2002.

FIELD OF THE INVENTION

The present invention relates to an improved electric pyrotechnic igniter, and specifically, to a remotely controlled igniter for use with consumer class fireworks.

BACKGROUND OF THE INVENTION

Professional pyrotechnicians commonly utilize electric or electronic igniters for the ignition of fireworks. These professional fireworks ignition systems utilize circuitry with capacitance discharge to increase firing voltage from a low voltage source to a delivered output of between 200 and 500 volts. Once discharged, the igniter is required to recharge, much like the recharging of a disposable camera flash circuit. Discharging the igniter allows high voltage to be conducted to a quantity of firework-mounted ignition devices know as electric matches. The electric match is a short length of two insulated wires that are bridged with a short length of resistive wire coated with a volatile chemical. Manual replacement of the standard fuse with the electric match is required. Electrodes are connected to the electric match and the firework is ready for discharge. This has the advantage in professional shows of virtually instantaneous discharge of the firework for precision control of displays. The electric match is consumed with each use. These systems are typically expensive and are therefore used principally by professional pyrotechnicians. A similar low voltage device is available for ignition of model rocket engines but requires the same electric match preparation as described above.

The above mentioned capacitive discharge igniter is not suitable for use with consumer class fireworks from the standpoint of practical application, safety and expense. For example, the firework preparation is unnecessarily laborious and time consuming for a small consumer class firework display. Preparing the firework by drilling into it is a dangerous activity as is the shipping and handling of the flammable and toxic chemicals, involved with the electric match. The capacitive discharge circuit is capable of producing a painful shock in much the same way as a high voltage stun gun. Additionally, these ignition systems are prohibitively expensive and complicated for typical consumer use.

Although the previous art of fuse igniters such as U.S. Pat. No. 2,114,176 to H. C. Christ (1938) shows an igniter utilizing resistance wire, there is no means to readily replace the wire were it defective. It is common knowledge within the industry that when a fuse is consumed there is considerable residue of a waxy deposit that can coat the resistive element rendering it useless for repeated ignitions. Additionally, the means of bringing the igniter of Christ or the fuse igniter clamp of U.S. Pat. No. 2,003,483 to J. S. Frye (1935) into contact with the fuse causes the user to be near the ignited fuse. For explosives having extremely long fuses such as those associated with mining and demolition the proximity of the user to the fuse is not relevant. However, consumer class fireworks typically have a fuse length of only a few inches at best, so that using devices such as that of Christ or Frye would place the user in the dangerous area of detonation.

The only alternative available to the above described for the ignition of consumer class fireworks are the non-electric means that are commonly used, such as matches, lighters and stick incense, called punks, which can maintain a hot ember at their tip for a few minutes. These devices are difficult and sometimes impossible to use in breezy or damp weather and users can easily ignite the fuse closer to the firework than intended, substantially shortening the time to detonation. More importantly, they all require the user to be dangerously close to the firework's point of detonation. Each year the U.S. Consumer Product Safety Commission Publishes a Fireworks annual report listing death and injury statistics, which indicates that about 10,000 people annually require emergency room visits due to fireworks related injuries.

BACKGROUND OF THE INVENTION—OBJECTS AND ADVANTAGES

Accordingly, several objects and advantages of the present invention are:

a) to provide an igniter which would allow users of consumer class fireworks to ignite said fireworks from a safe distance;

b) to provide an igniter where the ignition point on the fuse and time of ignition are safely controlled;

c) to provide an igniter which requires no generation or use of dangerous high voltage;

d) to provide an igniter with a simple and easy method of connecting to a firework fuse;

e) to provide an igniter that allows repeated use of the ignition element;

f) to provide an igniter which will allow quick and easy replacement of a damaged or dirty ignition element;

g) to provide an igniter that will work in a variety of adverse weather conditions;

h) to provide an igniter that requires no volatile or dangerous chemicals for operation; and i) to provide an igniter that requires no advance preparation of the firework for operation.

Further objects and advantages are to provide an igniter that requires no complicated or expensive circuitry, can be inexpensively manufactured, is reliable, is simple to use and is readily available to the general public. Still further objects and advantages will become apparent from a consideration of the ensuing description and drawings.

SUMMARY OF THE INVENTION

The present invention accordingly has an object to provide a novel electric pyrotechnic igniter free from the disadvantages in the prior art.

Thus, the electric pyrotechnic igniter of the present invention comprises a controlled power source providing low-voltage electricity to one or more remotely located, replaceable ignition elements that are housed in clips capable of holding the ignition elements into direct contact with firework fuses.

DRAWINGS—FIGURES

In the drawings, closely related drawings have the same number but different alphabetic suffixes.

FIG. 1 shows the preferred embodiment of the entire assembly, as it would be in use.

FIG. 2 shows an exploded view of the clip.

FIG. 3 shows the igniter element.

DRAWINGS—REFERENCE NUMBERS

10 power control unit housing

12 2-conductor wire

14 Clip
16 Firework
18 firework fuse
20 control point one
22 control point two
34 upper body of clip
36 lower body of clip
38 Spring
40 Standoff
42 power conductors
44 igniter element seat
46 male power connector
48 pivot hinge
50 substrate
56 helical heating member
58 conductive rivets
66 Ignition element

DETAILED DESCRIPTION—PREFERRED EMBODIMENT

Nothing in these figures is intended to suggest a single best embodiment or that other embodiments are not acceptable and workable. Other enhancements to the invention of this application are noted in the claims section but may not be identified here. Variations include but are not limited to; a power control unit capable of providing power to more than one clip/igniter element; the addition of a utility light on the housing or clip; and the addition of various lighting and/or sound generating components for use as decoration or entertainment.

FIG. 1

A preferred embodiment of the entire igniter assembly of the present invention is illustrated in FIG. 1. The user holds the power control unit 10. When the control point one 20 and the control point two 22 are simultaneously depressed power is conducted through the two-conductor wire 12 to the clip 14 where the firework 16 is detonated.

FIG. 2

For the construction of a clip (with leading edge of clip being the short edge nearest the compressive jaw)—the upper body of clip 34 and the lower body of clip 36 are constructed of nylon 6/6 VO, a heat resistive, non-conducting material. The overall dimensions of both the upper body of clip 34 and the lower body of clip 36 are 2" long by ⅛ deep by ⅜" wide. In addition, a utility light may be constructed on the body of the clip mechanism as so desired by one of ordinary skill in the art; this light having the necessary power supply and control means associated with it so as to effect functionality. The upper body of clip 34 is molded with a two-point pivot hinge 48 which mates with the corresponding pivot hinge 48 in the lower body of clip 36. The pivot hinge 48 is located at the center of the length of the clip with each pivot point located adjacent to an edge. The standoff 40 is constructed of 26-gauge brass, 2/16" wide and ½" long, with each of the long ends turned down 3/32" and serrated with 1/32" deep teeth. The serrations are provided to prevent the pressure of the standoff 40 from extinguishing the ignited fuse. The standoff 40 is insert molded into the compressive jaw of the upper body of clip 34 to a depth of 1/32" so that two standoffs 40 1/16" long protrude from the surface of the jaw of the upper body of clip 34 at 1/32" and 7/32" from the leading edge. Two conductors 42A and 42B are constructed of 26-gauge brass 1/16" wide and 2 5/16" long. Conductors 42A and 42B are insert molded 1/32" deep into and parallel to the upper surface of the lower body of clip 36, each located 1/32" from opposite adjacent edges. Each conductor 42A and 42B extends ¼" out from the rear surface of the lower body of clip 36 to form a mating male power connector 46. Each conductor 42A and 42B is folded up 90-degrees to exit the lower body of clip 36 ¼" from the leading edge, where they are extended 1/16" above the upper surface and are folded 100 degrees forward. Conductors 42A and 42B are also folded up 10 degrees at ⅛" from termination at the leading edge of the lower body of clip 36. This 100-degree fold with 10 degree opposite fold allows the conductors 42A and 42B to form a conductive seat, otherwise know as a mating ignition element seat 44 with the ignition element The two conductors may be attached to the body of the clip by any means known to those of ordinary skill in the art, including, mechanical, magnetic or adhesive means.

FIG. 3

For the construction of an ignition element 66.—A rectangle of high temperature industrial gasket material measuring ¼" wide by ⅜" long by 1/16" thick is provided as a structural substrate 50 for a heating member and attachment device. A typical heating member 56 being composed of 32 gauge Nichrome wire 1½" long coiled at a radius of 1/64" producing 15 coils along the middle 1⅜" of wire. The remaining two 1/16" ends of the helical heating member 56 are attached to the substrate 50 with 1/16" diameter conductive rivets 58 which penetrate and fasten to the substrate 50. The ignition element 66 is constructed to mate with the igniter element seat 44 of FIG. 2 and to provide sufficient heat to ignite common consumer class firework when energized with a power supply of 6 volts, given the associated resistances in the connecting wire.

We claim:

1. A igniter assembly, comprising: a low voltage power supply with mechanism and housing; for same, associated control compression clip with electrical connectors and seat for an ignition element, and a heat producing ignition element.

2. The igniter assembly as claimed in claim 1, wherein the ignition element is composed of an area of resistive heating material as the heating member, a structural substrate of non-conductive, non-flammable material as a base for said heating member, and a means of attaching said heating member to said substrate.

3. The igniter assembly as claimed in claim 2, wherein the heating member is securely attached or mounted to the structural substrate of the ignition element by a member of a group consisting of conductive tape, adhesive, staple, rivet or by the configuration of the heating member itself.

4. The igniter assembly as claimed in claim 2, wherein the heating member of the ignition element is a configuration of wire, ribbon, film or membrane resistive heating material, having sufficient area and configuration to produce a concentrated area of heat sufficient enough to ignite pyrotechnic fuse material.

5. The igniter assembly as claimed in claim 2, wherein the ignition element is constructed to mate with the conductive seat, such that the heating member is in electrical contact with both positive and negative contact points in said seat and produce a completed electric circuit with the power supply and the switching device.

* * * * *